US012774832B2

(12) United States Patent
Gopalan et al.

(10) Patent No.: US 12,774,832 B2
(45) Date of Patent: Oct. 27, 2026

(54) DIRECT EXPANSION (DX) REFRIGERANT EVAPORATOR WITH LIQUID EJECTOR

(71) Applicant: Evapco, Inc., Taneytown, MD (US)

(72) Inventors: Shridhar Gopalan, Westminster, MD (US); Greg Derosier, Eldersburg, MD (US)

(73) Assignee: Evapco, Inc., Taneytown, MD (US)

( * ) Notice: Subject to any disclaimer, the term of this patent is extended or adjusted under 35 U.S.C. 154(b) by 84 days.

(21) Appl. No.: 18/778,327

(22) Filed: Jul. 19, 2024

(65) Prior Publication Data

US 2025/0027693 A1 Jan. 23, 2025

Related U.S. Application Data

(60) Provisional application No. 63/527,687, filed on Jul. 19, 2023.

(51) Int. Cl.
*F25B 39/02* (2006.01)

(52) U.S. Cl.
CPC ..... *F25B 39/028* (2013.01)

(58) Field of Classification Search
CPC ..... F25B 39/028; F25B 2341/001; F25B 2341/0012; F25B 2341/0015
See application file for complete search history.

(56) References Cited

U.S. PATENT DOCUMENTS

| | | | | |
|---|---|---|---|---|
| 1,836,318 | A | 12/1931 | Gay | |
| 2006/0016214 | A1 | 1/2006 | Gorbounov et al. | |
| 2009/0229305 | A1 | 9/2009 | Yamada et al. | |
| 2013/0251505 | A1 | 9/2013 | Wang et al. | |
| 2018/0320944 | A1* | 11/2018 | Prins | F25B 49/022 |
| 2020/0141620 | A1* | 5/2020 | Derosier | F25B 41/00 |
| 2023/0160610 | A1* | 5/2023 | Mahmoud | F25B 41/20 62/115 |

OTHER PUBLICATIONS

International Search Report and Written Opinion issued in Application No. PCT/US2024/038791 on Dec. 19, 2024, 10 pages.

* cited by examiner

*Primary Examiner* — Elizabeth J Martin
(74) *Attorney, Agent, or Firm* — Bookoff McAndrews, PLLC

(57) ABSTRACT

A system and method for increasing the refrigeration capacity of a direct expansion refrigeration system having an inlet separator and a liquid ejector in which heat absorbing capacity is increased by increasing coil liquid refrigerant flow but retaining liquid free evaporator outlet flow and also retaining few degrees of superheat. The liquid refrigerant flow is increased through local recirculation of liquid from coil outlet to coil inlet through an ejector which pumps the unevaporated liquid refrigerant from a lower pressure (suction pressure) to a higher pressure. The ejector is powered by either saturated or subcooled liquid after the expansion valve.

20 Claims, 4 Drawing Sheets

DIRECT EXPANSION (DX) REFRIGERANT EVAPORATOR WITH LIQUID EJECTOR

FIELD OF THE INVENTION

This invention relates to direct expansion evaporators in refrigeration systems.

SUMMARY OF THE INVENTION

One of the drawbacks of Evaporator DX technology when compared to pump overfeed systems is the reduction in cooling capacity due to the reduction in liquid refrigerant flow through the coil to achieve the superheat at the coil outlet and avoid liquid carryover.

This invention is an improvement on current DX technology evaporator coils in which heat absorbing capacity is increased by increasing coil liquid refrigerant flow but retaining liquid free evaporator outlet flow and also retaining few degrees of superheat. The liquid refrigerant flow is increased through local recirculation of liquid from coil outlet to coil inlet through an ejector which pumps the unevaporated liquid refrigerant from a lower pressure (suction pressure) to a higher pressure. The ejector is powered by either saturated or subcooled liquid after the expansion valve.

Accordingly, there is presented according to the invention an apparatus for improving the performance of a direct expansion refrigeration system, the apparatus including a liquid powered ejector 7 having a first ejector liquid inlet 71, a second ejector liquid inlet 72 and an ejector liquid outlet 73, an evaporator 9 having a distributor 91 and an outlet header 92, the distributor having a distributor liquid inlet 13 the outlet header having an outlet header liquid outlet 17 and an outlet header vapor outlet 19, the second ejector liquid inlet 72 connected to the outlet header liquid outlet 17, the ejector liquid outlet 73 connected to the distributor liquid inlet 13, the outlet header vapor outlet 19 configured to be connected to a compressor. According to the embodiment of FIG. 5, the first ejector liquid inlet 71 is configured to be connected to an expansion device 3.

According to alternative embodiments represented by FIGS. 2-4, the apparatus may include inlet separator 5, the inlet separator having an inlet separator inlet 51, a first inlet separator outlet 52 and a second inlet separator outlet 53, the first inlet separator outlet 52 being a liquid outlet, the first inlet separator outlet 52 connected to the first ejector liquid inlet 71, the inlet separator inlet 51 configured to be connected to an expansion device 3.

According to the embodiment of FIG. 2, the second inlet separator outlet 53 is a vapor outlet connected to a second (vapor) inlet 15 of the distributor 91.

According to the embodiment of FIG. 3, the second inlet separator outlet 53 is a vapor outlet connected to the outlet header 92 of the evaporator or to the outlet header vapor outlet 19.

According to embodiments represented by FIG. 4, the second inlet separator outlet 53 is a liquid and vapor outlet connected to a second (liquid and vapor) inlet 15 of the distributor.

According to further embodiments of the invention, the inlet separator and the ejector may be combined in an integrated refrigerant recycling device. Additional embodiments may include a heat exchanger connected to the expansion device to deliver cooled refrigerant to the expansion device.

According to yet another embodiment of the invention, a direct expansion refrigeration system is provided including refrigerant line connecting the following, in order: an expansion device, an inlet separator, a liquid powered ejector, an evaporator, and a compressor, the inlet separator configured to continuously and simultaneously send liquid refrigerant to the ejector and refrigerant vapor to an evaporator inlet or to an evaporator outlet, the liquid powered ejector configured to continuously and simultaneously receive liquid refrigerant from the inlet separator, receive liquid refrigerant from the evaporator outlet, and send liquid refrigerant to the evaporator inlet.

According to any of the foregoing embodiments, the evaporator outlet header may be replaced by or followed by a phase separator/accumulator to collect and separate refrigerant vapor and liquid from the evaporator, send liquid refrigerant to the second liquid inlet of the ejector and send refrigerant vapor to a compressor.

It is noted that while certain features and elements described hereinabove and below are described in the context of selected other features, elements and/or embodiments, it should be understood that every combination and sub-combination of the features and elements described herein is considered to be within the scope of the invention.

Figure 1:
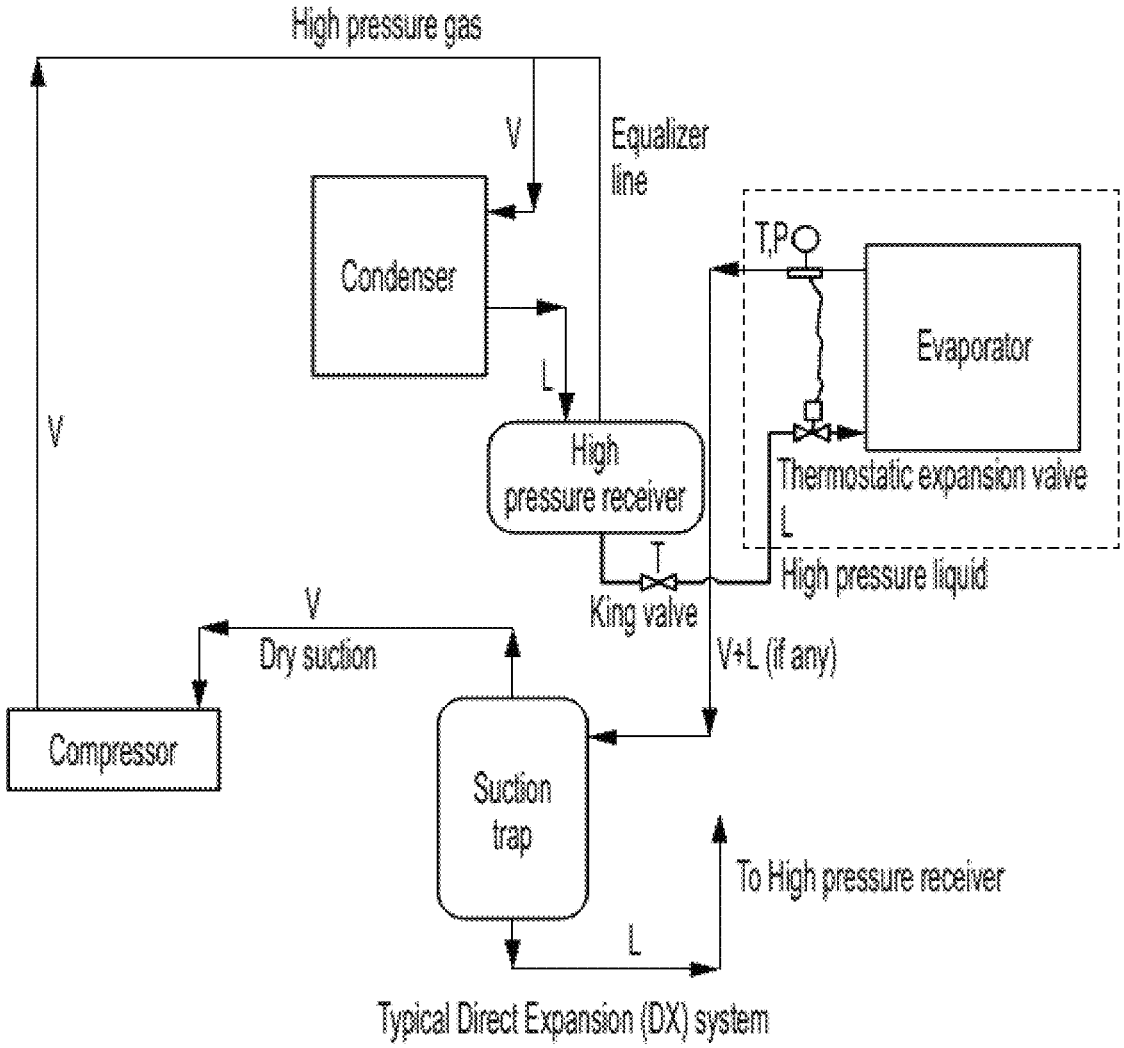
FIG. 1 is a representation of a standard direct expansion refrigeration system.

Features in the attached drawings are numbered with the following reference numerals:

3 expansion device.
5 inlet separator
51 inlet separator inlet
52 inlet separator first outlet
53 inlet separator second outlet
7 ejector
71 ejector first inlet
72 ejector second inlet/side port
73 ejector outlet
9 evaporator
91 evaporator inlet/distributor
92 evaporator outlet/suction header
13 distributor first inlet
15 distributor second inlet
17 outlet header liquid outlet
19 suction header line
21 distributor nozzle/orifice

DETAILED DESCRIPTION OF THE INVENTION

FIG. 1 shows a typical or standard direct expansion (DX) refrigeration system. High pressure, high temperature liquid from high pressure receiver enters the evaporator through a thermostatic expansion valve and a distributor. The thermostatic expansion valve regulates (opens or closes) based on the superheat of the outlet vapor with the goal of generating superheated vapor (superheat≥6° F.) to ensure dry suction for the compressor. However, this is not the case in practice, as unevaporated liquid tends to escape the evaporator resulting in reduction in superheat and closing of the thermostatic expansion valve to reduce the refrigerant flow rate. This reduces refrigeration capacity. Furthermore, there is also a need for a suction trap as shown in FIG. 1 to trap any liquid and ensure dry suction to the compressor.

A DX system as described above, which uses a distributor to distribute liquid to all circuits of the evaporator is also sensitive to maldistributions. Non-uniform distribution results in excess liquid flowing out of some circuit outlets, which will reduce superheat below target. This causes the thermostatic expansion valve to increase superheat back to target at the cost of reduced capacity.

FIGS. 2-5 show the alternative embodiments of the portion of a DX refrigeration system of the invention which replaces the portion of a prior art DX refrigeration system that is enclosed in dashed lines in FIG. 1.

Figure 2:
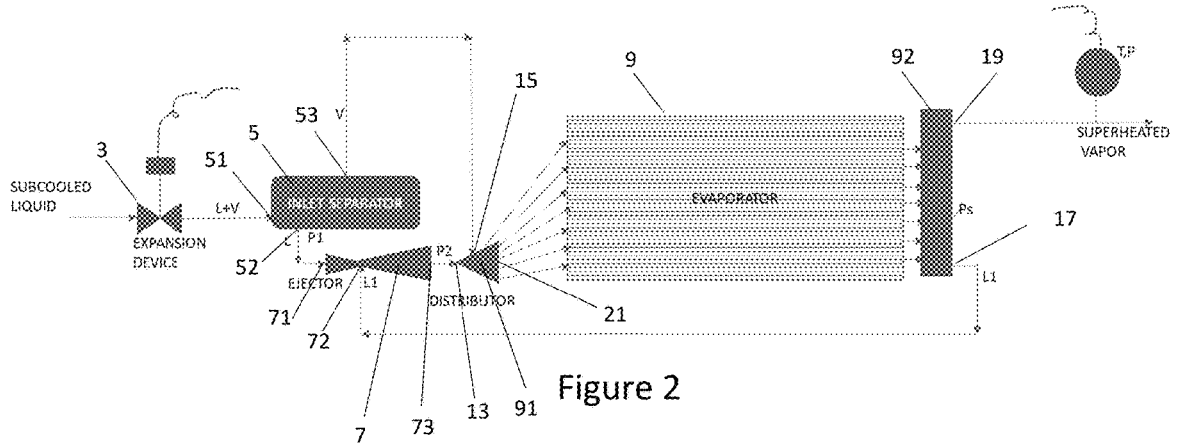
FIG. 2 is a schematic of a first embodiment of the invention in which vapor leaving the inlet separator is sent to the evaporator/evaporator distributor.
Figure 3:
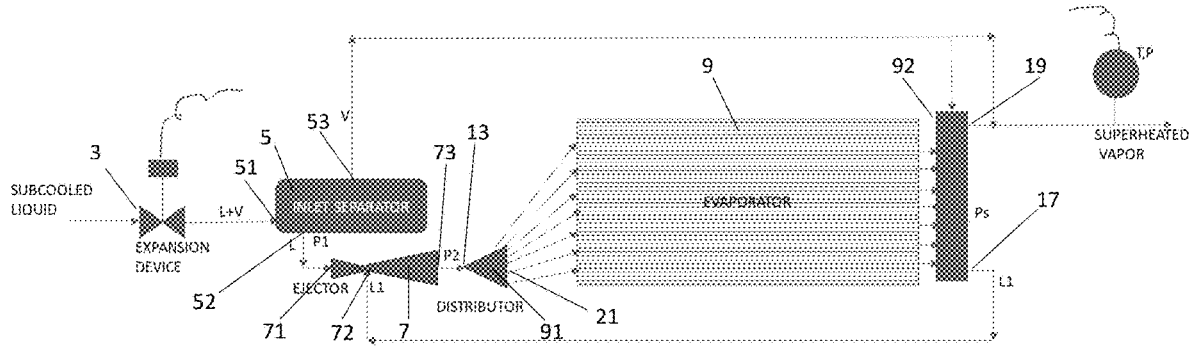
FIG. 3 is a schematic of a second embodiment of the invention in which vapor leaving the inlet separator is not sent to the evaporator/evaporator distributor.
Figure 4:
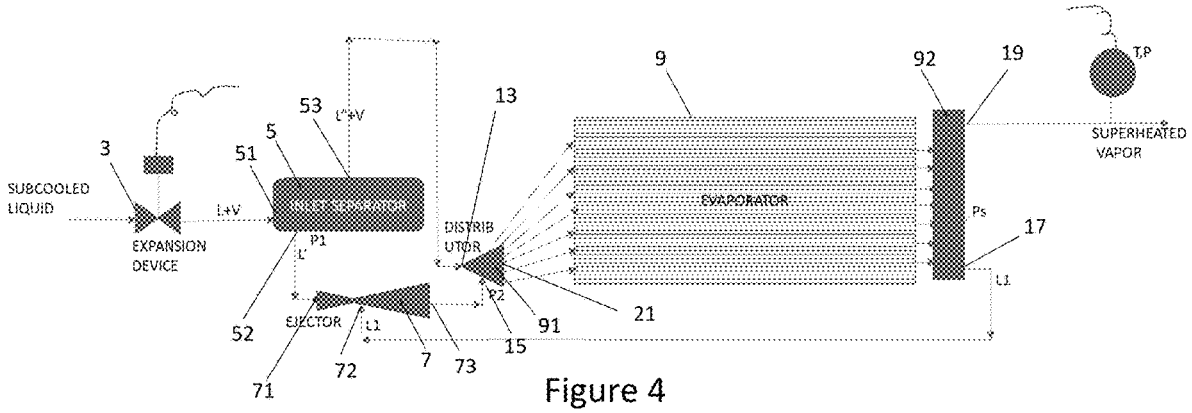
FIG. 4 is a schematic of a third embodiment of the invention in which a portion of the liquid leaving the inlet separator is combined with vapor sent to the evaporator/evaporator distributor.

Embodiments of FIGS. 2-4 feature an inlet separator and ejector combination that utilizes saturated or subcooled liquid from the separator after the subcooled liquid entering the expansion valve is throttled. The embodiment of FIG. 5 does not include the inlet separator.

Referring to the embodiment of FIG. 2, the flash gas generated in the inlet separator (shown as V) can vary depending on the liquid temperature of the entering subcooled liquid. Higher liquid temperature results in higher flash gas mass. In U.S. Pat. No. 11,493,245 B2 the inventors employed capacity boost for the evaporator using similar principles but using flash gas saturated vapor to power a vapor ejector. However, the inventors discovered that when the amount of flash gas is not adequate (or zero) due to low liquid temperatures (<30° F.) or high degrees of subcooling, the use of a vapor ejector provides no advantage. However, the inventors discovered that in such cases, saturated (or subcooled) liquid could be effectively used as motive for the ejector. Accordingly, the present invention uses saturated/subcooled liquid to increase the capacity of the evaporator coil by recirculating additional liquid through the coil. The recirculated liquid improves heat transfer through higher internal surface contact with boiling liquid.

After the throttling process through an expansion valve 3, for example a motorized expansion valve as used in a standard refrigeration cycle, the mixture of liquid and vapor enters the inlet separator 5 at pressure P1 as shown in FIG. 2. The saturated liquid (L) from the separator enters an ejector 7 at inlet pressure of P1. The ejector 7 accelerates the liquid (decrease in enthalpy=increase in kinetic energy) resulting in a low pressure ($P_{min}$) at the throat of the ejector, which is indicated by the location of the side port 72 showing liquid L1, so $P_{min}$ should be below suction pressure Ps (pressure in the suction header). As a result, refrigerant fluid (mostly liquid) is entrained from the bottom of the suction header 92 to the side port 72 of the ejector 7 shown by L1. The small amount of vapor (V) from the inlet separator 5 is routed to the side port 15 of the distributor 91 through a fixed regulating orifice that can be calculated for a given application along with the size of the ejector. The sum L+L1+V enters the distributor 91 which is then evenly distributed to the various circuits of the evaporator 9. Note that the standard distributor nozzle or orifice is preferably removed for this application so as to not cause additional back pressure to the ejector. The velocity of the refrigerant mixture at the exit of the ejector is sufficient to evenly distribute the flow rate. While only one distributor is shown in the Figures, one or more distributors may be used, for example in the case for high cooling capacity coils.

FIG. 3 shows an alternate embodiment with inlet separator 5 and ejector 7, where the small amount of vapor (V) from the inlet separator 5 can be directly routed to the suction connection line 19 or to the suction header 92 as shown with dashed lines. In this embodiment, it is important to ensure the vapor line is liquid free by sizing its regulating orifice accurately, while the embodiment of FIG. 2 can tolerate small amounts of liquid in the vapor line from the inlet separator since it is routed to the distributor.

FIG. 4 shows an alternate embodiment in which saturated or slightly subcooled liquid (L') from the bottom of the separator 5 is used as motive to ejector 7, while a two-phase mixture (L"+V) from the top 53 of the separator 5 feeds the distributor 91. According to this embodiment, the distributor 91 is equipped with a distributor nozzle/orifice 21 to regulate the correct amount of flow through the distributor, while the remainder of the liquid flows through the ejector 7. The division of mass flow rate between the ejector 7 and distributor 91 depends on the ejector entrainment ratio. According to preferred embodiments, the liquid portion of the refrigerant inlet mass flow could be 50% or more on the ejector side. According to the embodiment of FIG. 4, two-phase mixture of varying quality enters the distributor side (where "quality" refers to the ratio of vapor mass flow to total mass flow), while the ejector motive is ensured saturated liquid. This provides operational flexibility for varying Liquid temperatures, weather conditions, load conditions etc., where the distributor feed from the top of the separator 5 adjusts (automatically) with no effect on ejector operation. In addition, operation is more robust, as a 50%-50% or 60-40 flow split can be targeted, and even when the numbers are slightly off, the error has little to no effect on performance. Furthermore, there are no minimum feed liquid temperature requirements according to this embodiment and no dependence on flash gas generation (V) for ejector operation. For example, V could be 0 in the above examples. Since liquid is used, high ejector motive mass flow rates are available, which helps increase the recirculated flow rates from the suction header. High recirculated flow rate enables improved Evaporator heat transfer (capacity) at low superheat and no liquid carry over. Typically about 15%-20% of the inlet flow rate is expected for recirculated flow rate and enhanced heat transfer over DX.

Figure 5:
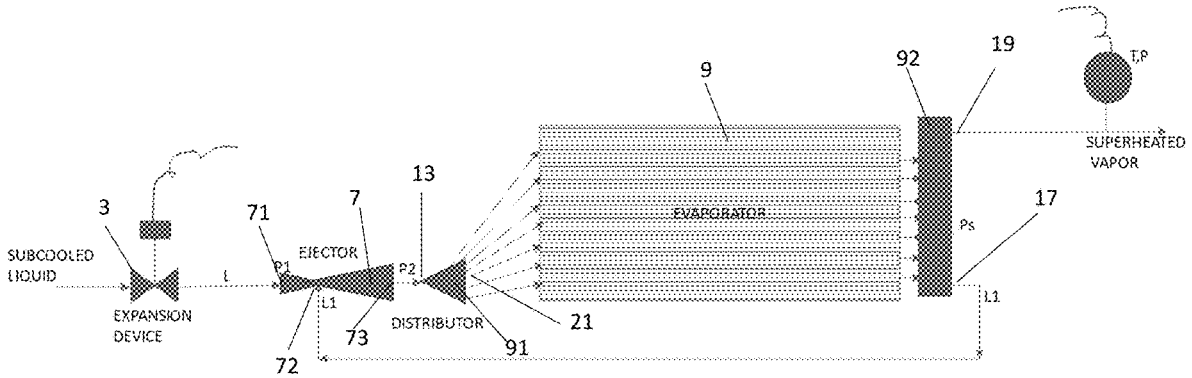
FIG. 5 is a schematic of a fourth embodiment of the invention that does not include an inlet separator.

The invention can be used without an inlet separator as shown in FIG. 5, particularly if the liquid remains subcooled after the expansion valve. In this case, the subcooled liquid entering the expansion valve 3, exits as subcooled liquid (L). The liquid then powers an ejector 7 similar to the embodiment in FIG. 2 to generate a low pressure $P_{min}$ and entrain liquid L1 from the suction header 92. The sum L+L1 enters the distributor 91 and is evenly distributed to the various circuits. As above, the distributor standard nozzle is removed for this application. Note that only one distributor is shown in the schematic but more than one distributor may be used according to the invention, which can be the case for high cooling capacity coils.

According to all embodiments of the invention, all the excess liquid flow L1 from the coil is continuously recirculated and only refrigerant vapor in a superheated state (like a DX evaporator) is sent to the compressor. The degree of super heat can be about 3° F., while in a conventional DX it is >6° F. If conventional DX evaporator is operated below 6° F., there is a high possibility of liquid carryover to the suction. This is the benefit of the invention, since it actively removes any unevaporated liquid/liquid carry over from the suction header and increased wetting inside the evaporator coil tubes, which results in cooling capacity boost. It is also a regenerative method since the ejector is powered by entering enthalpy of the system and requires no additional energy. The recirculated liquid can increase the cooling capacity of the coil significantly up to 38%.

Similar to a conventional DX coil, superheat is measured at the outlet of the coil on the suction connection (as shown in Figures) that regulates the opening of the expansion valve to target a specified super heat of 3° F.

It will be appreciated by those skilled in the art that changes could be made to the embodiments described above without departing from the inventive concept thereof. It is understood, therefore, that this invention is not limited to the particular embodiments disclosed, but it is intended to cover modifications within the spirit and scope of the present invention as outlined in the present disclosure and defined according to the broadest reasonable reading of the claims that follow, read in light of the present specification. In particular, while certain features and elements described herein are described in the context of selected other features, elements and/or embodiments, it should be understood that every combination and sub-combination of the features and elements described herein is considered to be within the scope of the invention.

The invention claimed is:

1. An apparatus for improving the performance of a direct expansion refrigeration system comprising:

a liquid powered ejector having a first ejector liquid inlet, a second ejector liquid inlet and an ejector liquid outlet, an evaporator having an evaporator inlet and an evaporator outlet, the evaporator outlet having an evaporator outlet liquid outlet and an evaporator outlet vapor outlet, the second ejector liquid inlet connected to the evaporator outlet liquid outlet, the ejector liquid outlet connected to a distributor liquid inlet, and the evaporator outlet vapor outlet configured to be connected to a compressor.

2. The apparatus of claim 1, wherein the first ejector liquid inlet is configured to be connected to an expansion device.

3. The apparatus of claim 1, further comprising an inlet separator, the inlet separator having an inlet separator inlet, a first inlet separator outlet and a second inlet separator outlet, the first inlet separator outlet being a liquid outlet, the first inlet separator outlet connected to the first ejector liquid inlet, the inlet separator inlet configured to be connected to an expansion device.

4. The apparatus of claim 3, wherein the second inlet separator outlet is a vapor outlet connected to a vapor inlet of the evaporator inlet.

5. The apparatus of claim 3, wherein the second inlet separator outlet is a vapor outlet connected to the evaporator outlet or to the evaporator outlet vapor outlet.

6. The apparatus of claim 3, wherein the second inlet separator outlet is a liquid and vapor outlet connected to a liquid and vapor inlet of the evaporator inlet.

7. The apparatus of claim 3, wherein the inlet separator and the liquid powered ejector are configured to be combined in an integrated refrigerant recycling device.

8. The apparatus of claim 2, wherein the expansion device is configured to receive refrigerant from a heat exchanger.

9. The apparatus of claim 2, wherein the evaporator outlet is an outlet header.

10. The apparatus of claim 2, wherein the evaporator outlet is a phase separator.

11. The apparatus according to claim 1 wherein the evaporator inlet is a distributor.

12. The apparatus of claim 1, further including an expansion device having an expansion device outlet that is directly fluidly connected to the first ejector liquid inlet.

13. A direct expansion refrigeration system comprising:

at least one refrigerant line connecting the following, in order:

an expansion device, an inlet separator, a liquid powered ejector, an evaporator, and a compressor, the inlet separator configured to continuously and simultaneously send liquid refrigerant to the ejector and refrigerant vapor to an evaporator inlet or to an evaporator outlet, the liquid powered ejector configured to continuously and simultaneously receive liquid refrigerant from the inlet separator, receive liquid refrigerant from the evaporator outlet, and send liquid refrigerant to the evaporator inlet.

14. The direct expansion refrigeration system of claim 13, wherein the evaporator includes a distributor that includes the evaporator inlet, the inlet separator being configured to send refrigerant vapor to the evaporator inlet.

15. The direct expansion refrigeration system of claim 13, wherein the evaporator includes a header that includes the evaporator outlet, the inlet separator being configured to send refrigerant vapor to the evaporator outlet.

16. An apparatus for a refrigeration system, the apparatus comprising:

a liquid powered ejector having a first ejector liquid inlet, a second ejector liquid inlet and an ejector liquid outlet;

an evaporator having an evaporator inlet and an evaporator outlet;

the evaporator outlet having an evaporator outlet liquid outlet and an evaporator outlet vapor outlet;

the second ejector liquid inlet connected to the evaporator outlet liquid outlet;

the ejector liquid outlet connected to a distributor liquid inlet;

the evaporator outlet vapor outlet configured to be connected to a compressor; and an inlet separator, the inlet separator having an inlet separator inlet, a first inlet separator outlet and a second inlet separator outlet, the first inlet separator outlet being a liquid outlet, the first inlet separator outlet connected to the first ejector liquid inlet, the inlet separator inlet configured to be connected to an expansion device, wherein the second inlet separator outlet is a vapor outlet or a liquid and vapor outlet connected to a vapor inlet or to a liquid and vapor inlet of the evaporator inlet.

17. The apparatus of claim 16, wherein the first ejector liquid inlet is configured to be connected to an expansion device.

18. The apparatus of claim 16, wherein the evaporator outlet is an outlet header.

19. The apparatus of claim 16, wherein the evaporator outlet is a phase separator.

20. The apparatus of claim 16, wherein the evaporator inlet is a distributor.

* * * * *